US005788242A

United States Patent [19]

Rudell et al.

[11] Patent Number: 5,788,242

[45] Date of Patent: Aug. 4, 1998

[54] TWO-SIDED TABLETOP BASKETBALL GAME

[75] Inventors: Elliot Rudell, Torrance; George T. Foster, Long Beach, both of Calif.

[73] Assignee: Elliot A. Rudell, Torrance, Calif.

[21] Appl. No.: 701,977

[22] Filed: Aug. 23, 1996

[51] Int. Cl.[6] ..... A63F 7/00

[52] U.S. Cl. ..... 273/317.3; 273/357; 273/394; 273/399

[58] Field of Search ..... 273/317.1, 317.3, 273/394, 395, 396, 397, 398, 399, 400, 401, 402, 357, 127 C, 122 R, 119 R, 118 R, 127 R, 129 W, 129 T; 473/447, 448

[56] References Cited

U.S. PATENT DOCUMENTS

| | | | |
|---|---|---|---|
| 159,937 | 2/1875 | Klobassa | 273/123 R |
| 2,658,495 | 11/1953 | Elliott | 273/389 |
| 2,886,321 | 5/1959 | Tarte | 273/375 |
| 3,119,620 | 1/1964 | Peterson | 273/125 R |
| 3,233,896 | 2/1966 | King | 273/397 |
| 3,685,829 | 8/1972 | Barlow | 273/357 |
| 3,834,701 | 9/1974 | Hashimoto | 273/357 |
| 4,177,992 | 12/1979 | Todokoro | 273/399 |
| 4,239,214 | 12/1980 | Brenner | 273/402 |
| 4,245,842 | 1/1981 | Kuna | 273/399 |
| 5,228,691 | 7/1993 | McAlley | 273/317.3 |
| 5,375,828 | 12/1994 | Shikami | 279/399 |
| 5,480,147 | 1/1996 | Ethier | 273/317.3 |
| 5,499,821 | 3/1996 | Rycroft | 273/399 |

*Primary Examiner*—Sebastiano Passaniti
*Attorney, Agent, or Firm*—Blakely Sokoloff Taylor & Zafman

[57] ABSTRACT

A game that allows one player to win by scoring goals at a faster rate than the opposing player. The game includes a vertical wall that has a first goal attached to a first side and a second goal attached to a second opposite side of the wall. The game also has a first launcher that can project a ball toward the first goal and a second launcher that can project a ball toward the second goal. The goals may be coupled to openings in the wall by chutes that guide the balls into the court of the opposing player when a player makes a basket. The game can be played by having each player project balls into their basket so that the balls roll into the court of the opposing player. The first player to run out balls wins the game.

14 Claims, 3 Drawing Sheets

TWO-SIDED TABLETOP BASKETBALL GAME

BACKGROUND OF THE INVENTION

1. Field of the Invention

The present invention relates to a table top basketball game.

2. Description of Related Art

There have been developed various miniature basketball games that require the participants to throw a ball through a basketball hoop. Milton Bradley Company marketed a table top game under the trademark HOT SHOT BASKETBALL which contained a launcher that projected a ball toward a moving hoop. Cadaco marketed a table top game under the trademark SUPER SLAM BASKET which contained two separate launchers that allowed two players to project balls at hoops mounted on adjacent backboards. Captoys marketed a game under the trademark DOUBLE JAM which contained two adjacent hoops that were attached to a single backboard mounted to a door. All of these game kept score by providing points each time a player made a basket. None of the games required one player to shoot and score more quickly than the other player. It would be desirable to provide a game that is played by two players which rewards a player for scoring more quickly than the other player. The introduction of a time element increases the skill level of the game.

SUMMARY OF THE INVENTION

The present invention is a game that allows one player to win by scoring goals at a faster rate than the opposing player. The game includes a vertical wall that has a first goal attached to a first side and a second goal attached to a second opposite side of the wall. The game also has a first launcher that can project a ball toward the first goal and a second launcher that can project a ball toward the second goal. The goals may be coupled to openings in the wall by chutes that guide the balls into the court of the opposing player when a player makes a basket. The game can be played by having each player project balls into their basket so that the balls roll into the court of the opposing player. The first player to run out of balls wins the game.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
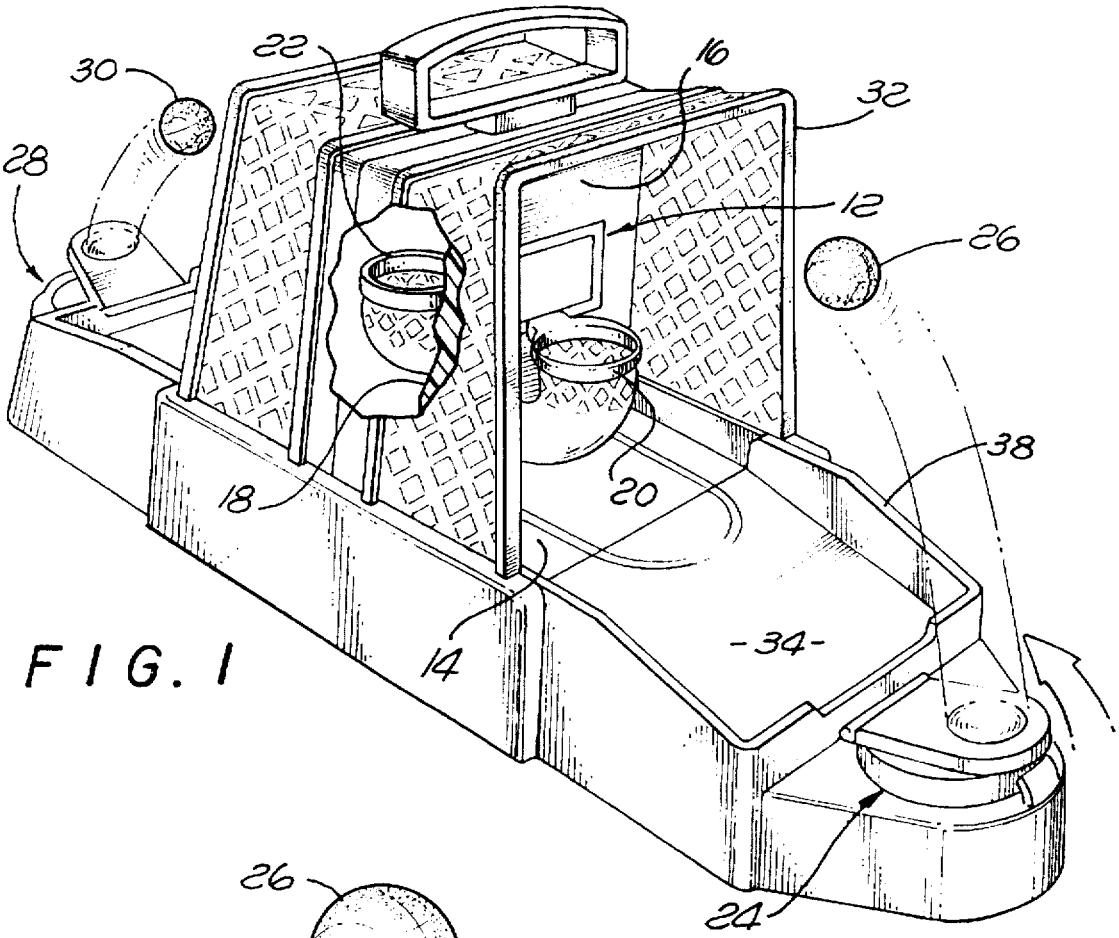
FIG. 1 is a perspective view of a game of the present invention.

Referring to the drawings more particularly by reference numbers, FIG. 1 shows a game 10 of the present invention.

The game 10 includes a vertical wall 12 that extends from a base 14. The wall 12 has a first side 16 and an opposite second side 18. Attached to the first side 16 of the wall 12 is a first goal 20. Attached to the second side 18 of the wall 12 is a second goal 22. The game also includes a first launcher 24 that can project a first ball 26 toward the first goal 20 and a second launcher 28 that can project a second ball 30 toward the second goal 22. Although only two balls are shown and described, it is to be understood that the game typically contains a number of balls located on each side of the wall 12.

The vertical wall 12 may have a pair of screens 32 that restrain the movement of the balls. Additionally, the game preferably has a first slanted floor 34 and a second slanted floor 36 that biases the balls back to the launchers 24 and 28. The slanted floors 34 and 36 may each have outer walls 38 to capture the balls. The goals are preferably constructed to simulate basketball hoops. Although a basketball game is shown and described, it is to be understood that the goals may be constructed to simulate a hockey net or any other type of scoring target.

Figure 2:
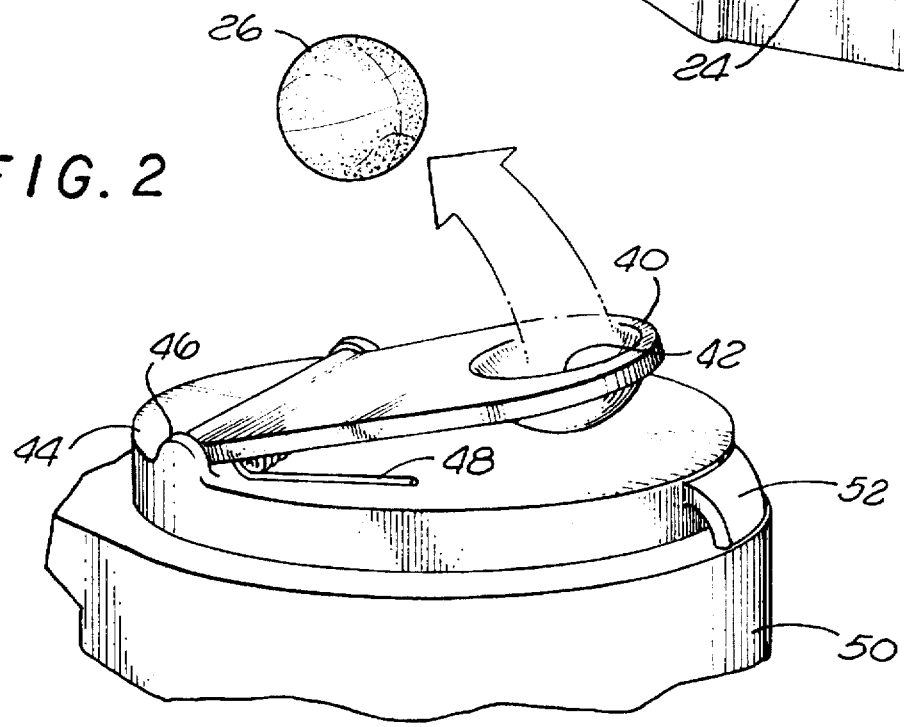
FIG. 2 is a perspective view of a launcher of the present invention.

As shown in FIG. 2, each launcher 34 and 36 may have a lever 40 which has a cup 42 that can hold a ball. The lever 40 is pivotally connected to a swivel plate 44 by a hinge 46. Each launcher also has a spring 48 that rotates the lever 40 and projects the ball when the player pushes and releases the lever 40. The projection of the ball is dependent upon the spring force of the spring 48. The spring force is dependent upon the deflection of the spring 48 and the corresponding movement of the lever 40 by the player. The player must be skillful in applying the right amount of force to project the ball into the goal. To further increase the skill level of the game, the swivel plate 44 may be pivotally connected to a stationary pedestal 50 so that the player must accurately align the lever 40 with the goal. The swivel plate 44 may have a tab 52 that allows the player to rotate the launcher and aim the ball.

Figure 3:
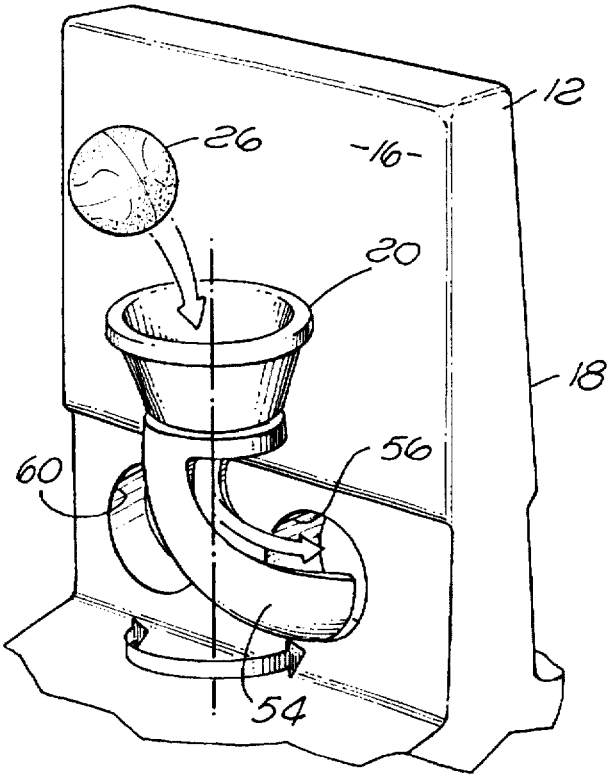
FIG. 3 is a perspective view showing a chute rotated to a two-player position.
Figure 4:
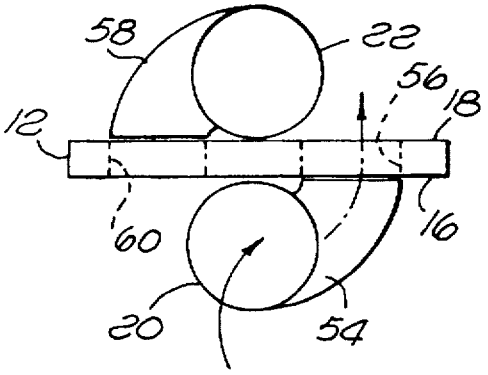
FIG. 4 is a top view showing two chutes of the game.
Figure 5:
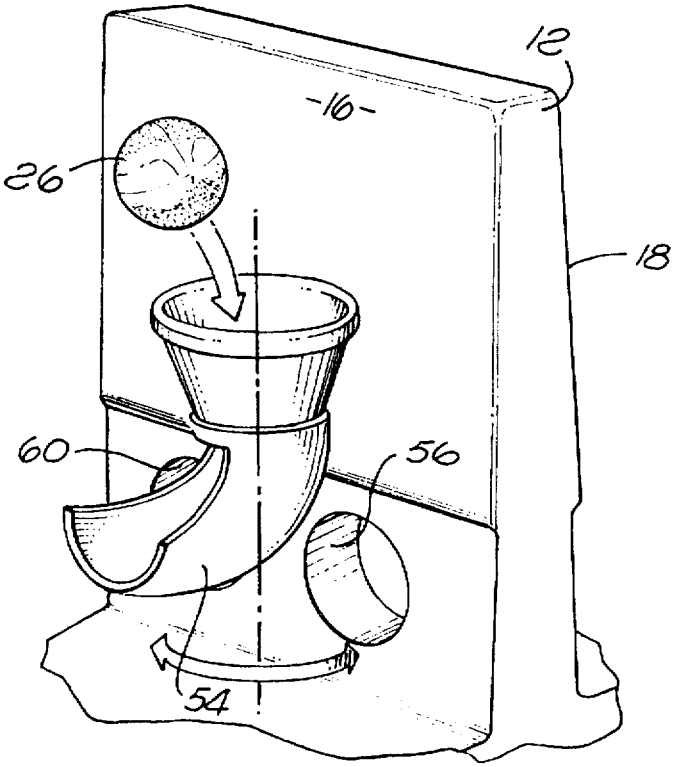
FIG. 5 is a perspective view showing a chute rotated to a single player position.

As shown in FIGS. 3 and 4, the game 10 has a first chute 54 that couples the first goal 20 to a first opening 56 in the wall 12, and a second chute 58 that couples the second goal 22 to a second opening 60 in the wall 12. The chutes guide the ball into the court of the opposing player when a player makes a basket. When the chutes 54 and 58 are oriented in this position, a game can be played wherein a player wins the game by making baskets at a faster rate than the opposing player. As shown in FIG. 5, a chute 54 can be rotated to a second position so that the ball 26 rolls back to the launcher 24 allowing a single player to play the game.

Figure 6:
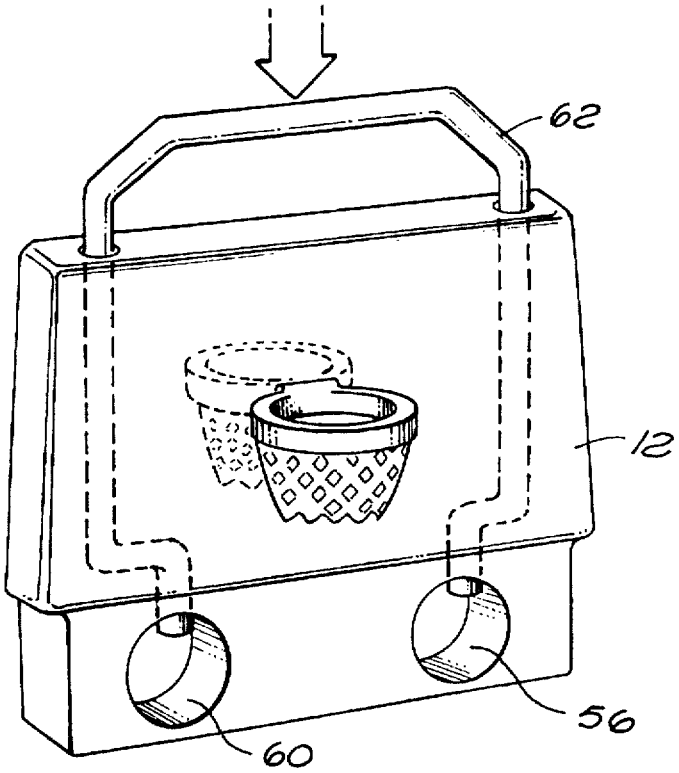
FIG. 6 is a perspective view showing a gate for openings of a wall of the game.

As shown in FIG. 6, the game 10 may have a gate 62 that can be pushed down so that the balls cannot roll through the openings 56 and 60. The game can be played so that each player makes baskets and rolls balls into the opposing players court. When a player has run out of balls, the player can push down the gate 62 to end the game.

Figure 7:
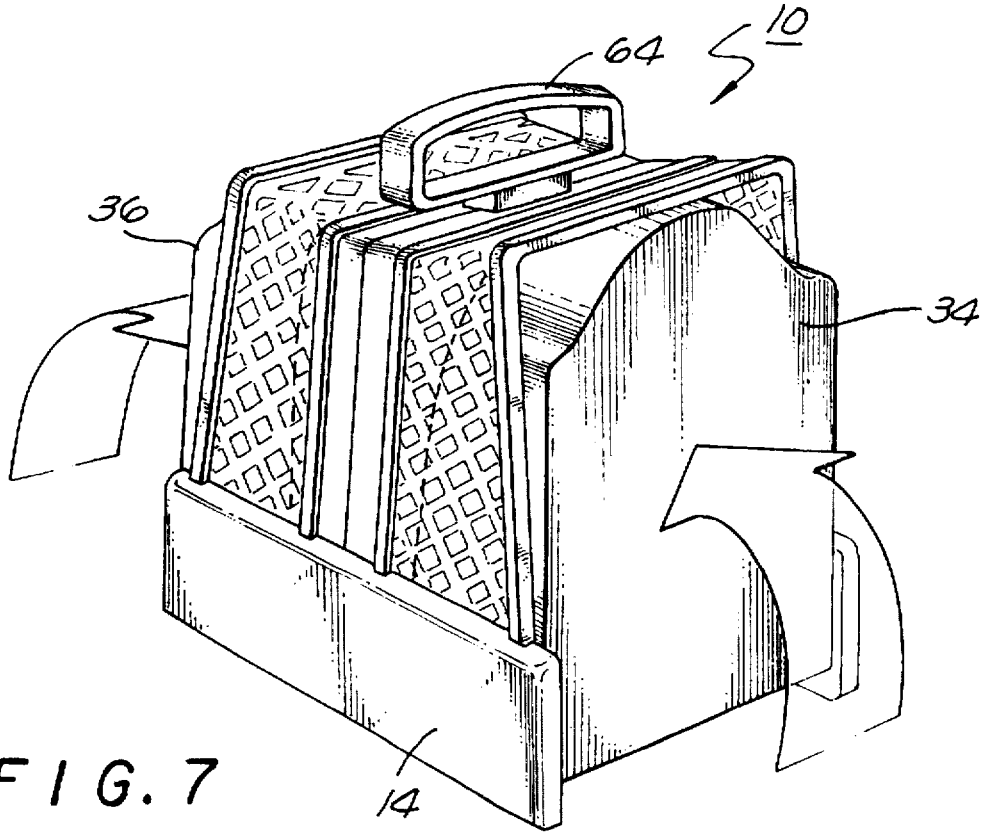
FIG. 7 is a perspective view showing the game in a folded position.

As shown in FIG. 7, the slanted floors 34 and 36 can be pivotally connected to the base 14 so that the launchers are folded into the wall 12 to reduce the size of the game 10. The game 10 may also have a handle 64 that allows a player to more readily carry the unit. The handle 64 is integral with the gate 62. The components are preferably constructed from molded plastic material to reduce the cost of producing the game.

In operation, each player is initially provided with a number of balls. The players then manipulate the launchers to project the balls into the goals so that the balls roll into the opposing players court. The first player to run out of balls pushes down the gate 62 to end the game. The player with no balls is the winner of the game.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A game, comprising:

a wall that has a first side, an opposite second side and a first opening;

a first goal that is attached to said first side of said wall;

a second goal that is attached to said second side of said wall;

a first launcher that projects a first ball toward said first goal such that said first ball moves through said opening to said second side of said wall; and, a second launcher that projects a second ball toward said second goal.

2. The game as recited in claim 1, further comprising a first chute that couples said first goal to said first opening in said wall.

3. The game as recited in claim 1, further comprising a first chute that couples said first goal to said first opening in said wall, and a second chute that couples said second goal to a second opening in said wall.

4. The game as recited in claim 3, wherein said first and second chutes can each pivot from a position facing said first and second openings, respectively, to a position facing said first and second launchers, respectively.

5. The game as recited in claim 1, further comprising a gate that can be pushed into a position to prevent said first ball from moving to said second side of said wall.

6. The game as recited in claim 1, wherein said first and second goals are each a basketball hoop.

7. The game as recited in claim 1, further comprising a first slanted floor that biases said first ball to said first launcher and a second slanted floor that biases said second ball to said second launcher.

8. A game, comprising:

a wall that has a first side and an opposite second side, said wall further having a first opening and a second opening;

a first goal that is attached to said first side of said wall;

a second goal that is attached to said second side of said wall;

a first launcher that projects a first ball toward said first goal;

a second launcher that projects a second ball toward said second goal;

a first chute that couples said first goal to said first opening so that said first ball moves to said second launcher;

a second chute that couples said second goal to said second opening so that said second ball moves to said first launcher;

a first slanted floor that biases said first and second balls to said first launcher; and, a second slanted floor that biases said first and second balls to said second launcher.

9. The game as recited in claim 8, wherein said first and second goals are each a basketball hoop.

10. The game as recited in claim 9, wherein said first and second chutes can each pivot from a position facing said first and second openings, respectively, to a position facing said first and second launchers, respectively.

11. The game as recited in claim 10, further comprising a gate that can be pushed into a position to prevent said first and second balls from moving through said first and second openings.

12. A method for playing a game, comprising the steps of:

a) providing a wall which has a first goal attached to a first side of said wall, a second goal attached to an opposite second side of said wall, and a first opening in said wall;

b) projecting a first ball toward said first goal with a first launcher to move said first ball through said first opening to said second side of said wall; and, c) projecting a second ball toward said second goal with a second launcher.

13. The method as recited in claim 12, wherein said second ball moves through a second opening in said wall to said first side of said wall.

14. The method as recited in claim 12, further comprising a step of pushing a gate that closes said first opening when said first ball moves to said second side of said wall.

* * * * *